US006009954A

United States Patent [19]

Phillips

[11] Patent Number: 6,009,954

[45] Date of Patent: Jan. 4, 2000

[54] RESIDENTIAL FIRE SPRINKLER WATER SUPPLY SYSTEM

[76] Inventor: Mark A. Phillips, 2725 N. 21st St., Phoenix, Ariz. 85006

[21] Appl. No.: 09/026,997

[22] Filed: Feb. 23, 1998

[51] Int. Cl.[7] ..... A62C 35/00

[52] U.S. Cl. ..... 169/16; 169/9

[58] Field of Search ..... 169/9, 14, 16

[56] References Cited

U.S. PATENT DOCUMENTS 786,742 4/1905 Evans ..... 169/9

2,353,116 7/1944 Rider ..... 169/9

*Primary Examiner*—Kevin P. Shaver

*Assistant Examiner*—David Deal

[57] ABSTRACT

Described is a limited-demand water supply system for use in residential homes wherein a supply of water is automatically provided to fire sprinklers by means of air pressure. Multiple tanks or vessels in a connected fluid system are partially filled with water and then pressurized with air pressure provided by an air compressor. There is maintained sufficient air pressure to empty the water in the vessel system through the fire sprinkler heads, when open. Preferably, to efficiently comply with most current fire system regulations, a set of vessels of less than about 200 gallons capacity each is filled about two-thirds with water and then air-pressurized to about 150 pounds per square inch.

20 Claims, 4 Drawing Sheets

RESIDENTIAL FIRE SPRINKLER WATER SUPPLY SYSTEM

BACKGROUND OF THE INVENTION

1. Field of the Invention

This invention relates to providing an improved residential fire sprinkler limited-demand water supply system. More particularly, this invention concerns such a system for use in residential homes wherein a supply of water is automatically provided to fire sprinklers by means of air pressure.

2. Description of the Prior Art

A growing number of homeowners and fire authorities are recognizing the benefits of installing automatic fire sprinkler systems in homes. Some jurisdictions have mandated installation through local ordinances. Automatic fire sprinklers are generally installed in homes in accordance with Local Fire Authority and the National Fire Protection Association (NFPA) requirements. The NFPA has set present requirements in NFPA Standards 13D and 13R. These codes require a sustained water supply at a given water pressure for a given period of time. This is referred to as the system demand. The system demand for a single family residence is, generally, a minimum 60 pounds of water pressure to force water through the sprinkler heads for a period of 10 minutes.

Typically, there are areas where the domestic line water pressure is not sufficient to provide the required system demand. In addition, there are a number of types of homes where installation of a self contained automatic fire sprinkler system is the preferred protection from fire. In particular, remote homes, homes with reduced water pressure, homes with limited fire protection, and homes which, especially in an emergency situation, have no dependable water supply and/or with limited or no electricity. In the prior art, the types of homes described above have been limited in fire protection to relatively expensive and bulky self-contained automatic fire sprinkler systems. Such self-contained automatic fire sprinkler systems typically (for example, see U.S. Pat. No. 4,366,865 to James J. Makibbin) contain a single large "dead" water tank to hold water and one or more electric pumps to pump the water upon system demand.

OBJECTS OF THE INVENTION

A primary object of the present invention is to fulfill the above-mentioned need by the provision of an improved residential fire sprinkler water supply system. A further primary object of the present invention is to provide such a system which is efficient, relatively inexpensive, relatively easy to install, and dependable. In addition, it is a primary object of this invention to provide such a system that will supply a proper quantity of water to a fire independent of any electrical assistance. Other objects of this invention will become apparent with reference to the following invention descriptions.

SUMMARY OF THE INVENTION

According to a preferred embodiment of the present invention, this invention provides, in an automatic fire sprinkler system for residences of the type having automatic fire sprinkler heads, a limited-demand water supply system comprising: vessel means for storing fluids under pressure; fill means for placing water into such vessel means; pressure means for applying air under pressure directly to such vessel means; air pressure management means for managing application of such air under pressure to such vessel means; and line means for moving such water from such vessel means to a residential fire sprinkler riser system. And it provides such a water supply system further comprising control means for controlling such placing water and such applying air under pressure; and, further wherein such control means comprises a set of valves structured and arranged for permitting such placing of such water into such vessel means and then permitting essentially pneumatic sealing of such vessel means to permit such applying air under pressure, and a set of pressure meters structured and arranged for determining fluid pressure within such control means.

In addition, this invention provides such a water supply system wherein such control means is connected to such vessel means essentially above such vessel means. It also provides such a water supply system wherein such line means is connected to such vessel means essentially below such vessel means. And it provides such a water supply system wherein such pressure means comprises an air compressor. Also, it provides such a water supply system wherein such vessel means comprises multiple vessels; and, further, wherein each such vessel of such multiple vessels has a capacity of less than about 200 gallons; and, further, wherein each such vessel of such multiple vessels is partially filled with water; and, further, wherein about two-thirds of each such vessel of such multiple vessels is filled with water; and, further, wherein at least one vessel of such multiple vessels is essentially completely filled with air under pressure; and, further, wherein at least one vessel of such multiple vessels is essentially filled with water; and, further, wherein such at least one vessel essentially filled with water is situated beneath ground level; and, further, wherein such at least one vessel essentially filled with air under pressure is situated in a residential attic. And it provides such a water supply system wherein such vessel means contains, by volume, about two-thirds water and about one-third air under pressure; and, further, wherein such air under pressure is under a pressure of about 150 psi.

Moreover, according to a preferred embodiment thereof, this invention provides, in an automatic fire sprinkler system for residences of the type having automatic fire sprinkler heads, a limited-demand water supply system, using an assembly of connected multiple fluid-containment vessels, comprising the steps of: partially filling such assembly with water; essentially pneumatically sealing such assembly; and placing within such assembly air under pressure sufficient to empty such water through the fire sprinkler heads, when open, of such automatic fire sprinkler system. And it provides such a water supply system wherein such placing step is accomplished using an air compressor.

Even further, according to a preferred embodiment thereof, this invention provides a limited-demand water supply system comprising: a residential housing structure; a plurality of automatic fire sprinkler heads placed within such residential fire structure; a riser pipe system connecting such fire sprinkler heads with a supply of on-site stored water pressurized under sufficient air pressure to empty such stored water through such fire sprinklers, when open; such supply of such air-pressurized stored water comprising a plurality of connected vessels. Also, it provides such a water supply system wherein each such vessel of such plurality of connected vessels has a capacity of less than about 200 gallons.

DETAILED DESCRIPTION OF A PREFERRED EMBODIMENT AND THE BEST MODE OF PRACTICE

The described preferred embodiments of the present invention are particularly useful in residential-type small facilities in that each can be installed in a relatively compact space, or spaces, and is efficient economically and otherwise compared to other systems (even as a low-cost alternative in larger facilities). And each such embodiment can operate without the use of electricity, can significantly boost the water supply pressure to the fire sprinkler system, etc.

Figure 1:
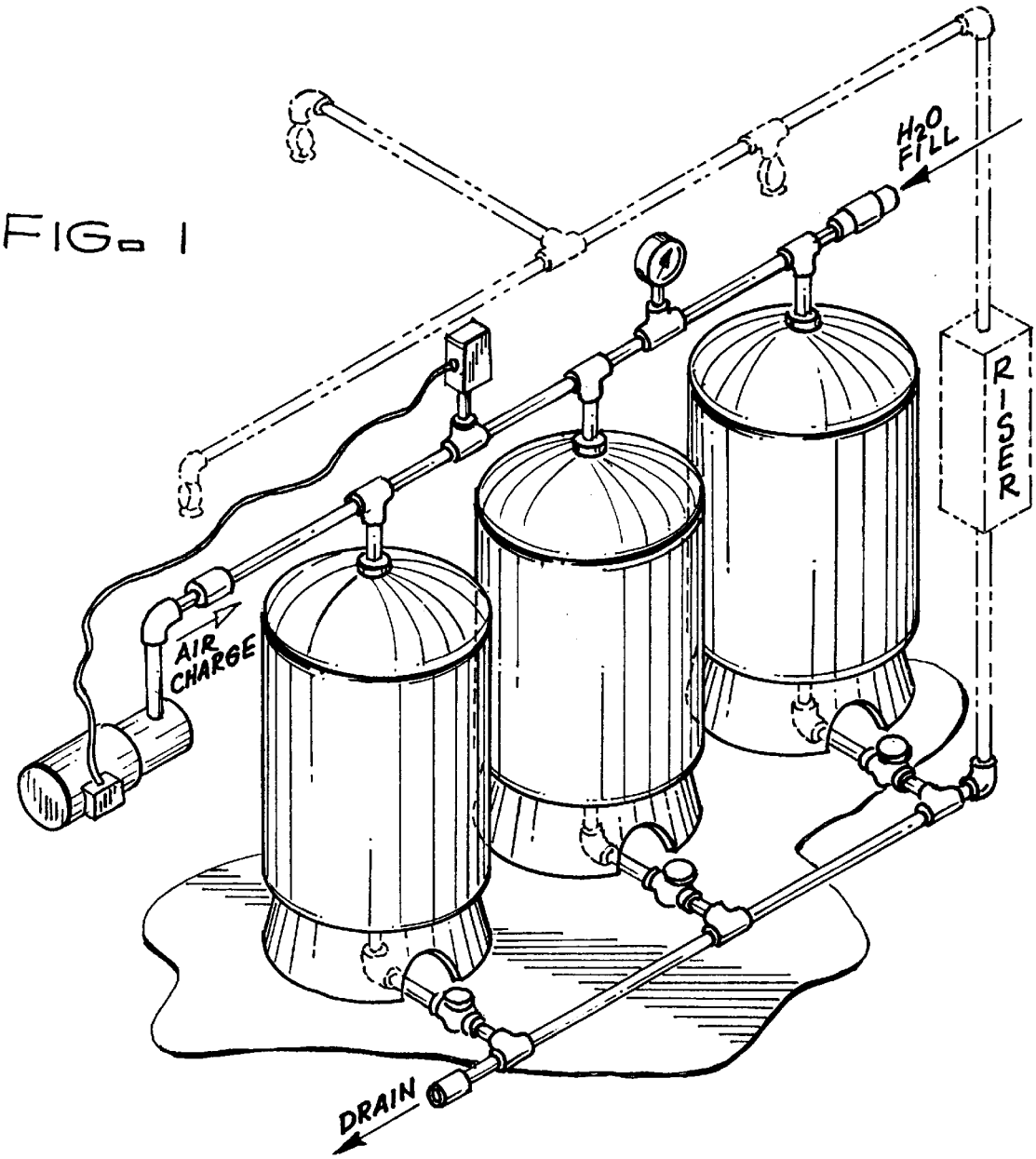
FIG. 1 is a perspective view of the a preferred embodiment of the present invention.

Referring now to the drawings, FIG. 1 illustrates a preferred embodiment of a residential fire sprinkler water supply system 20 of the present invention for providing automatic fire protection to a home 21 (shown in FIG. 4) or other similar small facility. For purposes of explanation, the residential fire sprinkler water supply system 20 is shown with three automatic sprinkler heads 22. The specific number and location of the automatic sprinkler heads 22 is specific to each individual installation and depends on many factors well known by those knowledgeable in the art. In the preferred embodiment of FIG. 1, the residential fire sprinkler water supply system 20 consists of a plurality of storage vessels or tanks 25, 26 and 27, embodying in this invention a vessel means for storing fluids under pressure. To provide storage vessels that are relatively light in weight, corrosion resistant, have low operating and maintenance costs, and possess sufficient tensile strength, tanks 25, 26 and 27 are preferably made of a lightweight fiberglass reinforced polyethylene material (such as tanks available from Structural North America, Chardon, Ohio).

Figure 2:
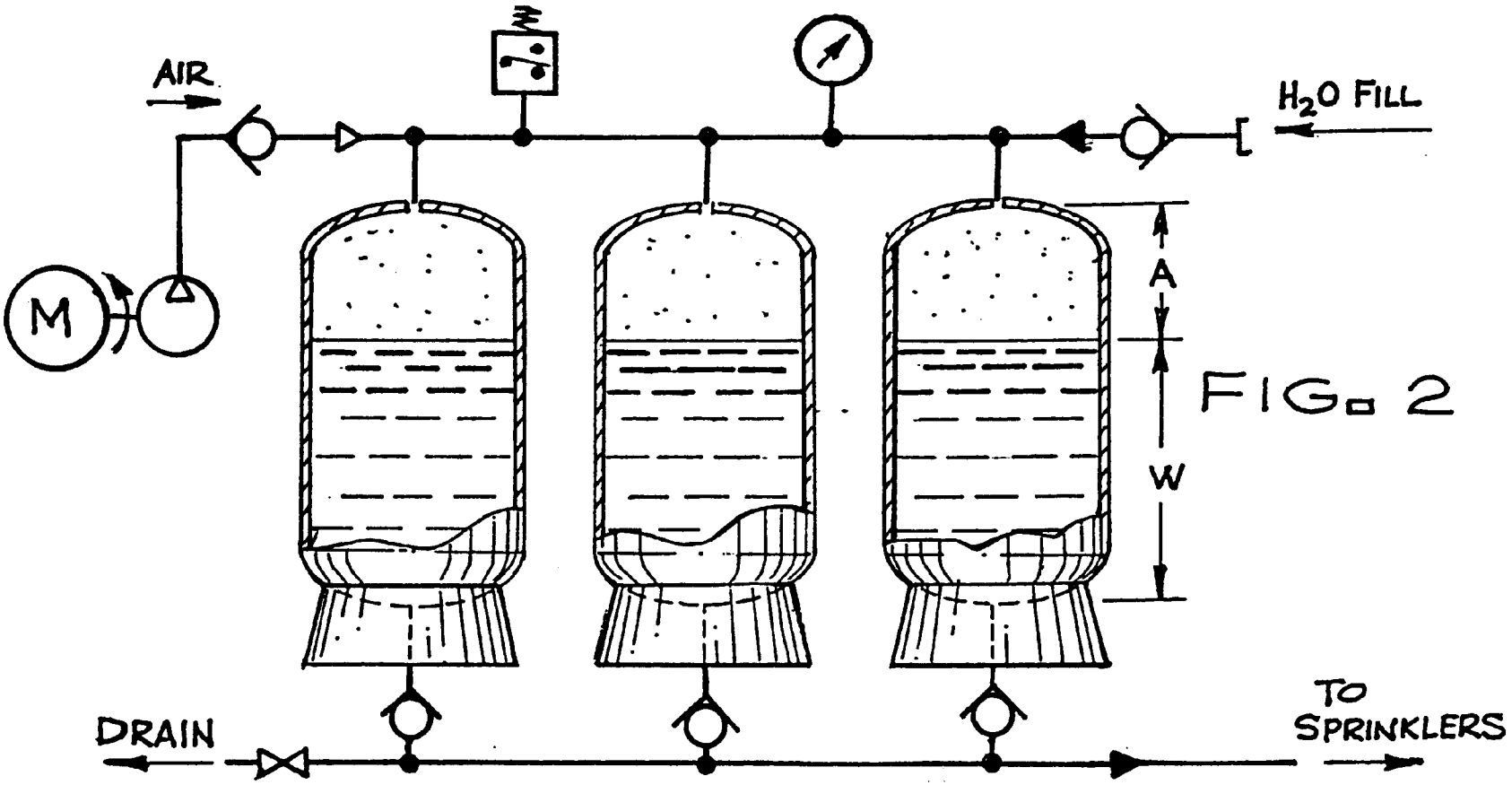
FIG. 2 is a diagrammatic cut-away view of FIG. 1, representing a preferred embodiment of the present invention.

The fire suppression medium is preferably water 29 which is maintained under pressure in tanks 25, 26, and 27 by (a "layer" of) compressed air 30 as best shown in FIG. 2, each such tank being about two-thirds full of water and about one-third full of compressed air. The sizing of the tanks 25, 26, and 27 and the necessary volume of compressed air 30 required to produce the desired delivery pressure of the water 29 is calculated by those skilled in the art in accordance with the Authority Having Jurisdiction and, generally, using NFPA (National Fire Protection Agency) guidelines. Typically, for one and two family residences, NFPA requires a sufficient water volume and air pressure so as to produce a ten-minute water supply to sprinkler heads 22. It has been found that to meet such NFPA requirements for this embodiment, tanks 25, 26 and 27 have preferred dimensions of about 30 inches by 72 inches. It has been found that these dimensions will yield a preferred storage capacity of 188 gallons per tank 25, 26 and 27, which will produce the required ten-minute supply of water at the initial system operating air pressure of preferably 150 psi. Such tanks embody herein that each such vessel of such multiple vessels preferably has a capacity of less than about 200 gallons, such size preference having a great cost and efficiency saving, etc. Of course, as the water is used during operation of the sprinkler system, the operating pressure goes down; and in this typical case such pressure may be as low as 15 psi when the last of the water is used. It is to be understood that these numbers have been determined according to the particular fire suppression requirements of a particular typical residence and that different water volumes requiring additional or less tanks than illustrated and described thus far may be used in particular instances.

As mentioned, in the illustrated preferred embodiment shown diagrammatically in FIG. 2, tanks 25, 26 and 27 are filled two-thirds full with water 29 and one-third full with compressed air 30 which maintains a static pressure in tanks 25, 26 and 27 of preferably about 150 psi. The preferred arrangement for and method of supplying the compressed air 30 and water 29 to tanks 25, 26, and 27 is substantially as shown and described herein with respect to FIGS. 1 and 2 (embodying herein control means for controlling such placing water and such applying air under pressure) but it is to be understood that the method shown is for illustrative purposes and may vary according to the physical dimensions of the area in which tanks 25, 26, and 27 are to be placed. In accordance with this preferred embodiment, on-site tanks 25, 26 and 27 are installed in an in-line series manner (as shown in FIGS. 1 and 2), in a garage or adjacent to the home 21 (preferably in a secure area to avoid tampering). To provide a means to fill tanks 25, 26 and 27 with water 29 and compressed air 30, the present invention provides for an upper tank piping assembly 31 having a water end 32 and an air end 33. Upper tank piping assembly 31 further comprises upper tank piping 34, preferably ½ inch in diameter. Connecting the upper tank piping assembly 31 to tanks 25, 26 and 27 is accomplished by means of upper piping couplers 35, preferably ½-inch tees of a well-known type, which are spaced along the upper tank piping assembly 31 in accordance to the spacing of tanks 25, 26 and 27. Threadedly attached to the piping couplers 35 and upper tank fittings **36*b* is a tank stem 36, preferably ½ inch in diameter, which completes the connection of tanks 25, 26 and 27 to the upper tank piping assembly 31**.

As illustrated in FIGS. 1 and 2, filling of tanks 25, 26 and 27 with water 29 is accomplished by means of a water inlet valve 37, preferably a ½-inch check valve (of a type selectable by those with ordinary skill in the art), being threadedly attached at the water end 32 of the upper tank piping assembly 31, embodying herein that such control means is connected to such vessel means essentially above such vessel means. Household water is then transported to tanks 25, 26 and 27 by a conveyancing means such as a typical garden hose (not shown) which can be threadedly attached to water inlet valve 37 or supplied in other well-known ways such as by threaded pipe couplers and adapters. This above-described water fill arrangement embodies herein fill means for placing water into such vessel means. As mentioned, according to this preferred embodiment of the present invention, tanks 25, 26 and 27 are filled to two-thirds capacity with water 29. To assist the operator in monitoring the water level, a sight glass 38 (shown in FIG. 1) is provided on each of tanks 25, 26, and 27. To provide a means of draining the water 29 from tanks 25, 26 and 27 so as to allow for system maintenance or in case of tank overfill, the drainage assembly 39 is provided with a main drain valve 40, preferably a ½-inch globe valve (of a type readily selectable by those skilled in the art). The main drain valve 40 is threadedly attached to drain piping 41 (preferably ½ inch in diameter), and allows for manual opening and closing of the drainage assembly 39.

To provide the compressed air 30 to tanks 25, 26 and 27, an air compressor 42 (of a type readily selectable by those skilled in the art) is provided. As shown in FIG. 1, the air compressor 42 is preferably attached, in well-known piping ways, to the air end 33 of the upper tank piping assembly 31. It is to be understood that the preferred configuration of air compressor 42 is as shown, though other configurations such as the use of a portable air compressor in conjunction with an air hose quick-disconnect (and attached in well known ways to the air end 33 of upper tank piping assembly 31) may be used. To provide a means to monitor and test the residential fire sprinkler water supply system 20, an air pressure gauge 43, of a type readily selectable by those skilled in the art, may be installed, in well-known piping ways, in the upper tank piping assembly 31 (as shown in FIGS. 1 and 2). To allow passage of the compressed air 30 while preventing the entry of water 29 into the air compressor 42, an air inlet valve 44, preferably a ½-inch check valve, is threadedly attached to the air end 33 of the upper tank piping assembly 31. This described arrangement embodies herein a set of valves structured and arranged for permitting such placing of such water into such vessel means and then permitting essentially pneumatic sealing of such vessel means to permit such applying air under pressure, and a set of pressure meters structured and arranged for determining fluid pressure within such control means.

In order to ensure that the required preferred pressure of 150 psi is maintained throughout the residential fire sprinkler water supply system 20, an air pressure switch 48 (of a type readily selectable by those skilled in the art) is attached, in well-known piping ways, to the upper tank piping assembly 31. In operation, the air pressure switch 48 is preset, in well-known ways, to monitor the air pressure in the upper tank piping assembly 31. If the air pressure drops below the preset level (due to system air leaks, etc.) the air pressure switch 48 automatically sends an electrical "power on" signal through standard conductive wires 49, which activates the air compressor 42. Upon activation, air compressor 42 supplies air pressure to the upper tank piping assembly 31 until the prescribed air pressure is achieved, at which point the air pressure switch 48 sends a "power off" signal thereby deactivating air compressor 42. The air compressor 42 may be powered by conventional home 21 electrical means or by an alternate electrical battery means (not shown). This above-described arrangement embodies herein pressure means (particularly the air compressor) for applying air under pressure directly to such vessel means; and it embodies air pressure management means for managing application of such air under pressure to such vessel means.

In the event of a fire, one or more automatic fire sprinkler heads 22 will activate and the pressurized water 29 will be forced from tanks 25, 26 and 27 and into drainage assembly 39. As best shown in FIG. 1, drainage assembly 39 comprises segments of tank drain piping 50, preferably one inch in diameter, which are threadedly attached by tank couplers 51, preferably one inch elbows, to each tank connection 52 (shown best in FIG. 2). To prevent backflow if tanks 25, 26 or 27 need to be replaced, the drainage assembly 39 further provides for drain valves 58, preferably one-inch check valves, which are threadedly attached to tank drain piping 50. Each segment of the tank drain piping 50 is threadedly attached to the main drain piping 41 by the use of a drain pipe coupler 59, preferably a one-inch tee. As indicated by the flow arrows in FIG. 1, the pressurized water 29 is forced from the main drain piping 41 and into transfer piping 60, preferably one inch diameter, from which the water 29 is routed to the individual automatic sprinkler heads 22. This above-described arrangement embodies herein line means for moving such water from such vessel means to a residential fire sprinkler riser system, and that such line means is connected to such vessel means essentially below such vessel means. It is to be understood that the material selection for the various components (i.e. piping, valves, etc.) comprising the residential fire sprinkler water supply system 20 will typically be in accordance with the applicable NFPA requirements.

As shown in alternate detail in FIGS. 1 and 2, a second air pressure switch 63, of the kind well-known in the art, may be attached, in well known ways such as a thread attachment, to the upper tank piping assembly 31. Alternately, a water flow switch 64 may be attached, also in well-known ways such as a thread attachment, to the drainage assembly 39 or transfer piping 60. These switches are intended to sense a dramatic drop in air pressure or a water flow through the particular system in use. If such an air pressure drop or water flow occurs, an audible alarm (not shown) is signaled and/or an automatic dialing alarm is transmitted to the Fire Authority.

As shown in FIG. 1, a fire sprinkler riser 66 may be attached, as shown, to transfer piping 60. The fire sprinkler riser 66 embodies those elements required by the Local Fire Authority for testing fire sprinkler systems and is conventional and known to those skilled in the art.

Figure 3:
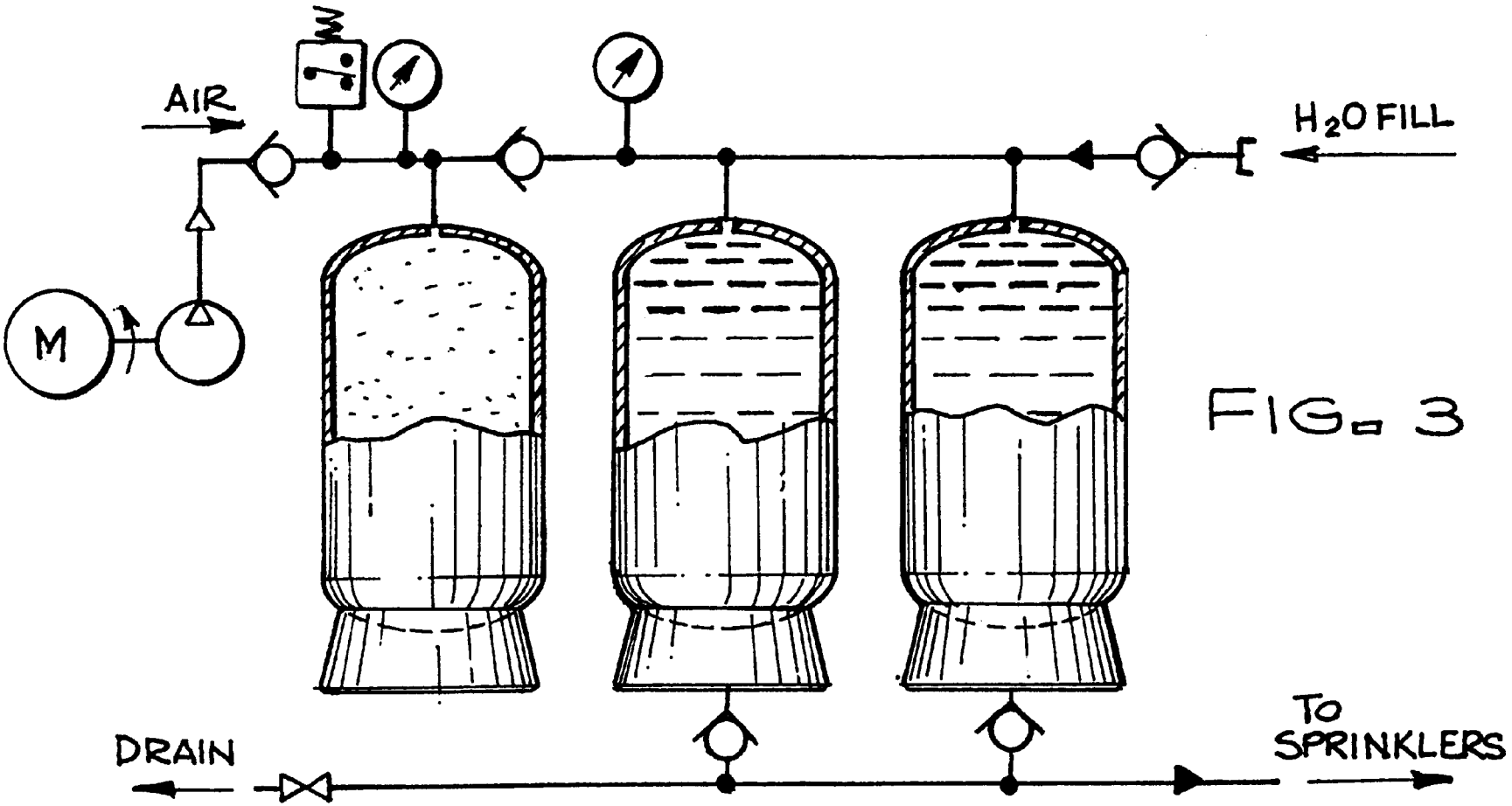
FIG. 3 is a diagrammatic cut-away view of FIG. 1 representing a second preferred embodiment of the present invention.

FIG. 3 shows a schematic representation of another preferred embodiment of a residential fire sprinkler water supply system 20 of the present invention. This embodiment also uses multiple tanks 25, 26 and 27 that are preferably arranged in an in-line formation, preferably either in a garage or adjacent to the home 21. In accordance with this preferred embodiment, tank 25 is completely filled with compressed air 30. The two remaining tanks 26 and 27 are completely filled with water 29 thereby maintaining a water 29 to compressed air 30 ratio of 2:1, as earlier discussed. To provide a means to fill tanks 25, 26 and 27 with water 29 and compressed air 30, the present invention provides for an upper tank piping assembly 31 having a water portion 67 with a water end 32, and an air portion 68 having an air end 33. To prevent water 29 from flowing into tank 25, there is provided for a valve 69, preferably a well-known ½-inch check valve structured and arranged between tank 25 and tank 26 and threadedly attached to upper tank piping assembly 31. Readying the residential fire sprinkler water supply system 20 for use consists, for example, of attaching a household water conveyancing means (not shown) to the water end 32 of the upper tank piping assembly 31 (as fully described with respect to FIG. 1). Water 29 passes through water inlet valve 37 and enters, and completely fills, tanks 26 and 27. Tanks 26 and 27 may be provided with a sight glass 38 (shown in FIG. 1) to monitor the filling process.

To assist in monitoring and testing the residential fire sprinkler water supply system 20, a water pressure gauge 70, of a kind well-known in such art, is threadedly attached to the water portion 67 of the upper tank piping assembly 31. Compressed air 30 is supplied to the upper tank piping assembly 31 by use of air compressor 42. The air compressor 42 is preferably attached, as shown, in well-known piping ways, to the air end 33 of the air portion 68. It is to be understood that the preferred configuration of air compressor 42 is as shown, though other configurations such as the use of a portable air compressor in conjunction with an air hose quick-disconnect, may be used under certain circumstances. As stated, the means to provide compressed air may be attached in well known ways to the air end 33 of upper tank piping assembly 31. To maintain the compressed air 30 within the upper tank piping assembly 31, an air inlet valve 44 is threadedly attached to the air end 33 of air portion 68. To monitor the air pressure in tank 25, an air pressure gauge 43 is threadedly attached to the air portion 68 of the upper tank piping assembly 31.

To monitor and maintain the air pressure in tank 25, an air pressure switch 48 is threadedly attached to the air portion 68 of the upper tank piping assembly 31. The air pressure switch 48 is structured and arranged to activate the air compressor 42 when the system pressure drops below pre-set levels as is fully described heretofore with respect to FIGS. 1 and 2. This preferred embodiment of the present invention also provides for a drainage assembly 39 as shown in FIG. 3. To ensure the system remains pressurized if either tank 26 or tank 27 need to be repaired or replaced, drain valves 58, preferably one-inch check valves, are provided in the drainage assembly 39 for each of tanks 26 and 27. To manually drain the water 29 from the system, the drainage assembly further comprises a main drain valve 40, preferably a ½-inch globe valve, threadedly attached to drain piping 41.

As in the preferred embodiment hereinbefore illustrated and described with respect to FIGS. 1 and 2, this preferred embodiment may also incorporate either a second air pressure switch 63 (shown in FIG. 1), or a water flow switch 64 (shown in FIG. 1). These switches are intended to sense a dramatic drop in air pressure or a water flow through the particular system in use. If such an air pressure drop or water flow occurs, an audible alarm (not shown) is signaled and/or an automatic dialing alarm is transmitted to the Fire Authority. In addition, this preferred embodiment may incorporate the use of a fire sprinkler riser 66 (as shown in FIG. 1) which embodies those elements required by the Local Fire Authority for testing of the improved self-contained fire sprinkler system 20. The fire sprinkler riser 66 is of a conventional type and known to those skilled in the art and is attached to the transfer piping 60 typically.

As shown schematically in FIG. 3, in the event of a fire, one or more automatic fire sprinkler heads 22 will activate thereby causing a pressure drop in the system. This pressure drop causes water 29 to be forced from the bottom of tanks 26 and 27 by the compressed air 30 in tank 25 and into the drainage assembly 39. As indicated by the directional flow arrows in FIG. 3, the water 29 is then forced to the activated automatic sprinkler heads 22 by means of the transfer piping 60 (shown best in FIG. 1). Again, the volume of water contained in tanks 26 and 27 and the system pressure is intended to meet NFPA requirements for one and two family residences of a ten-minute water system supply to the fire sprinkler heads 22.

Figure 4:
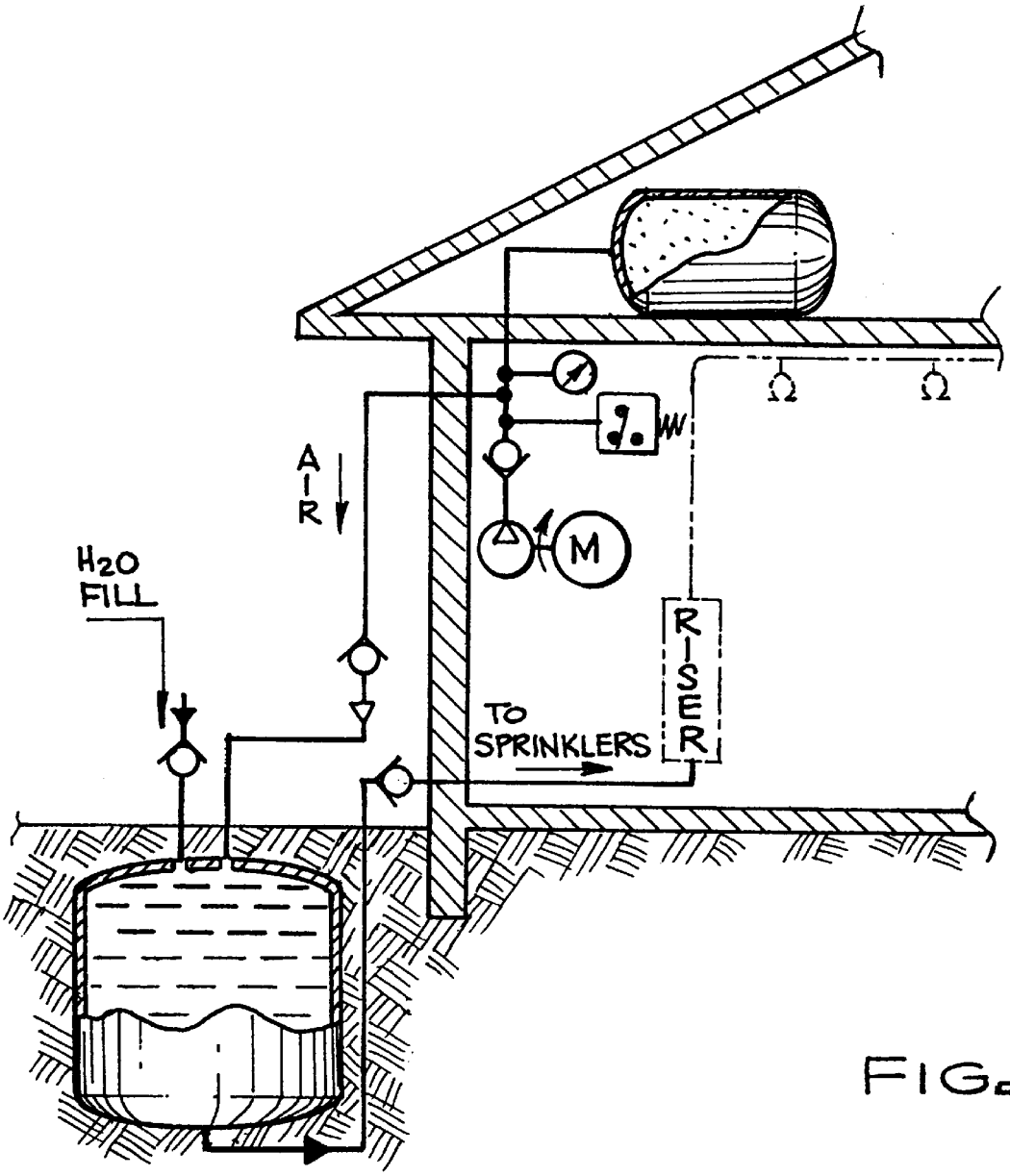
FIG. 4 is a diagrammatic cut-away view representing a third preferred embodiment of the present invention.
Figure 1:
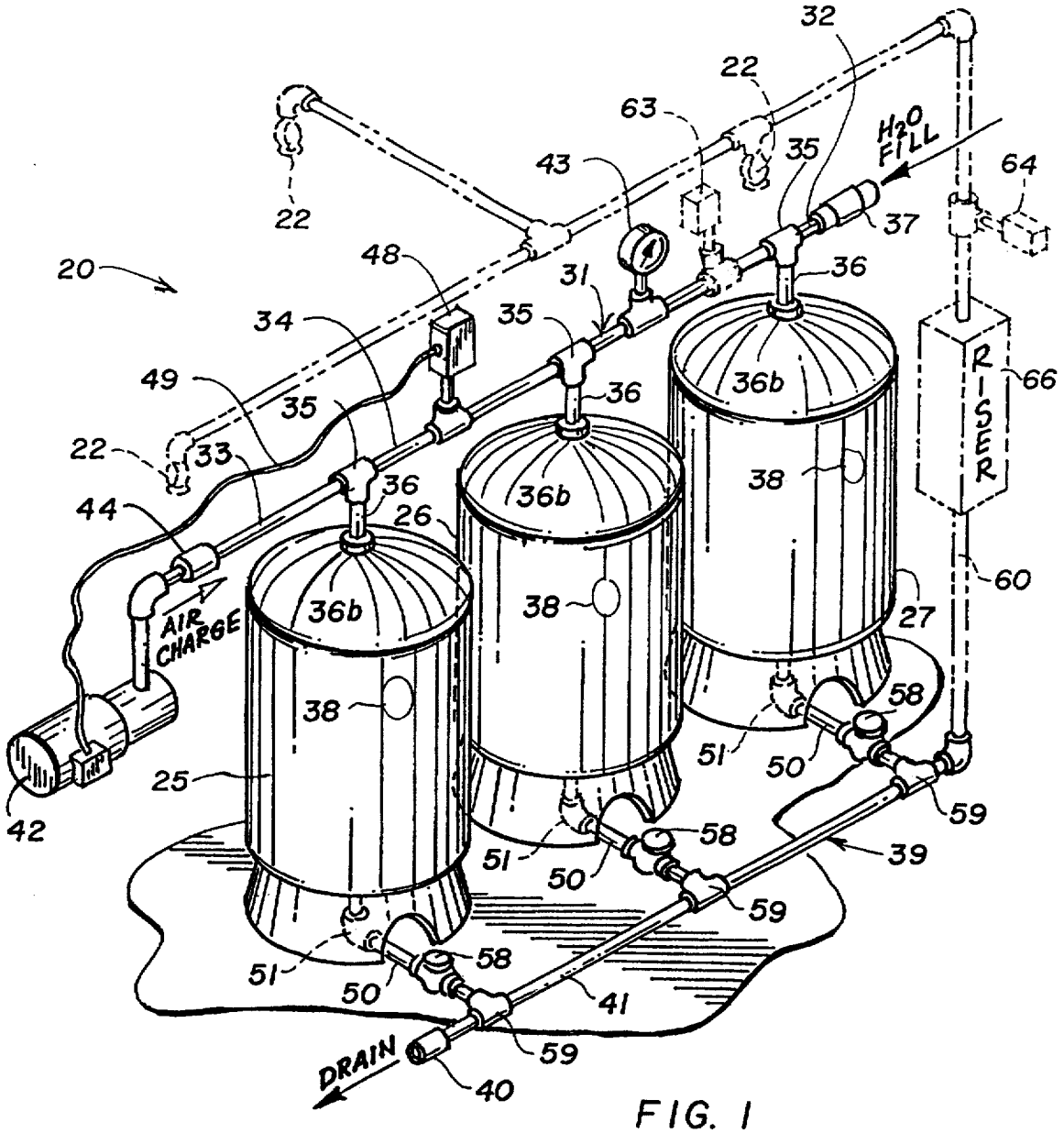
Figure 2:
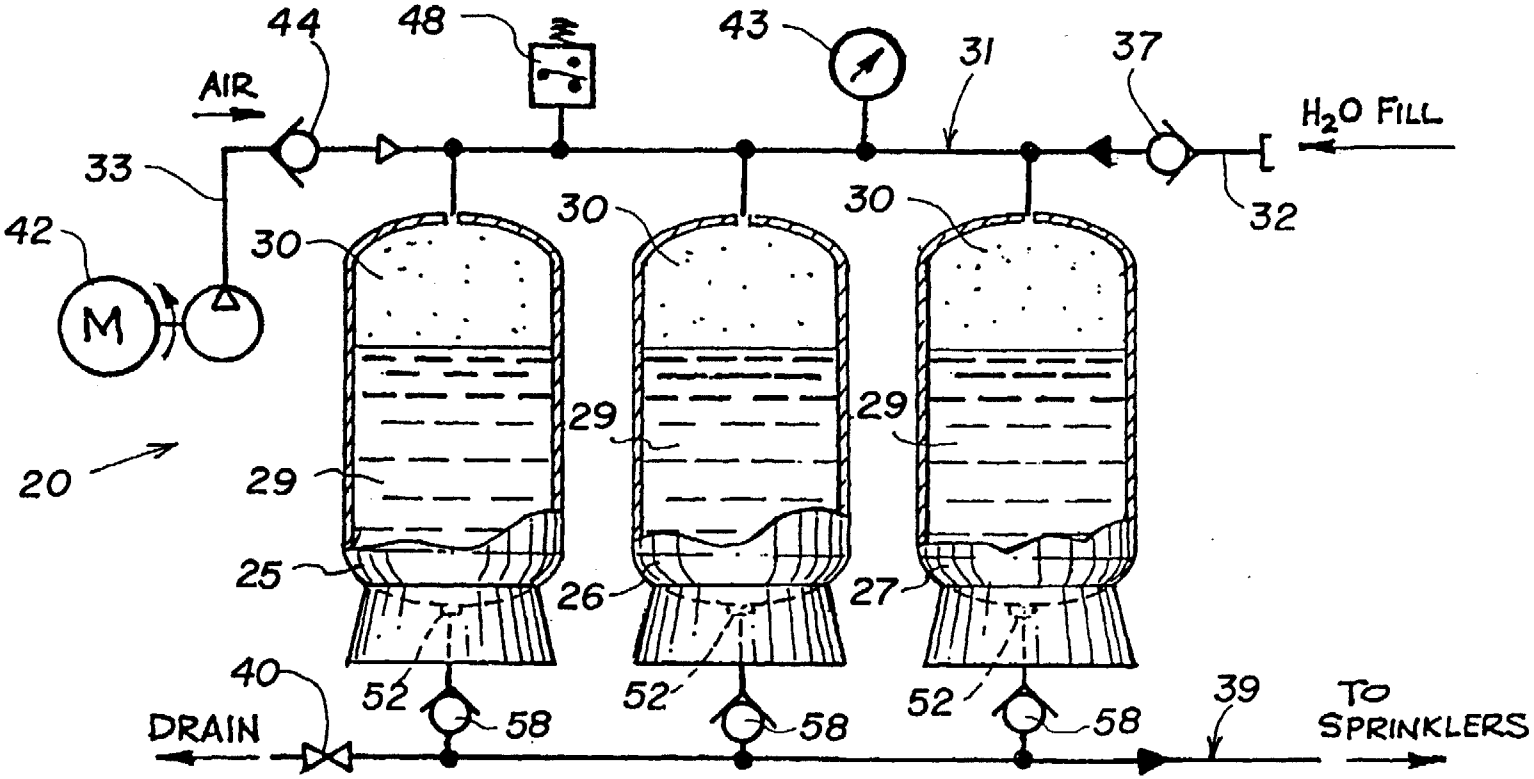
Figure 3:
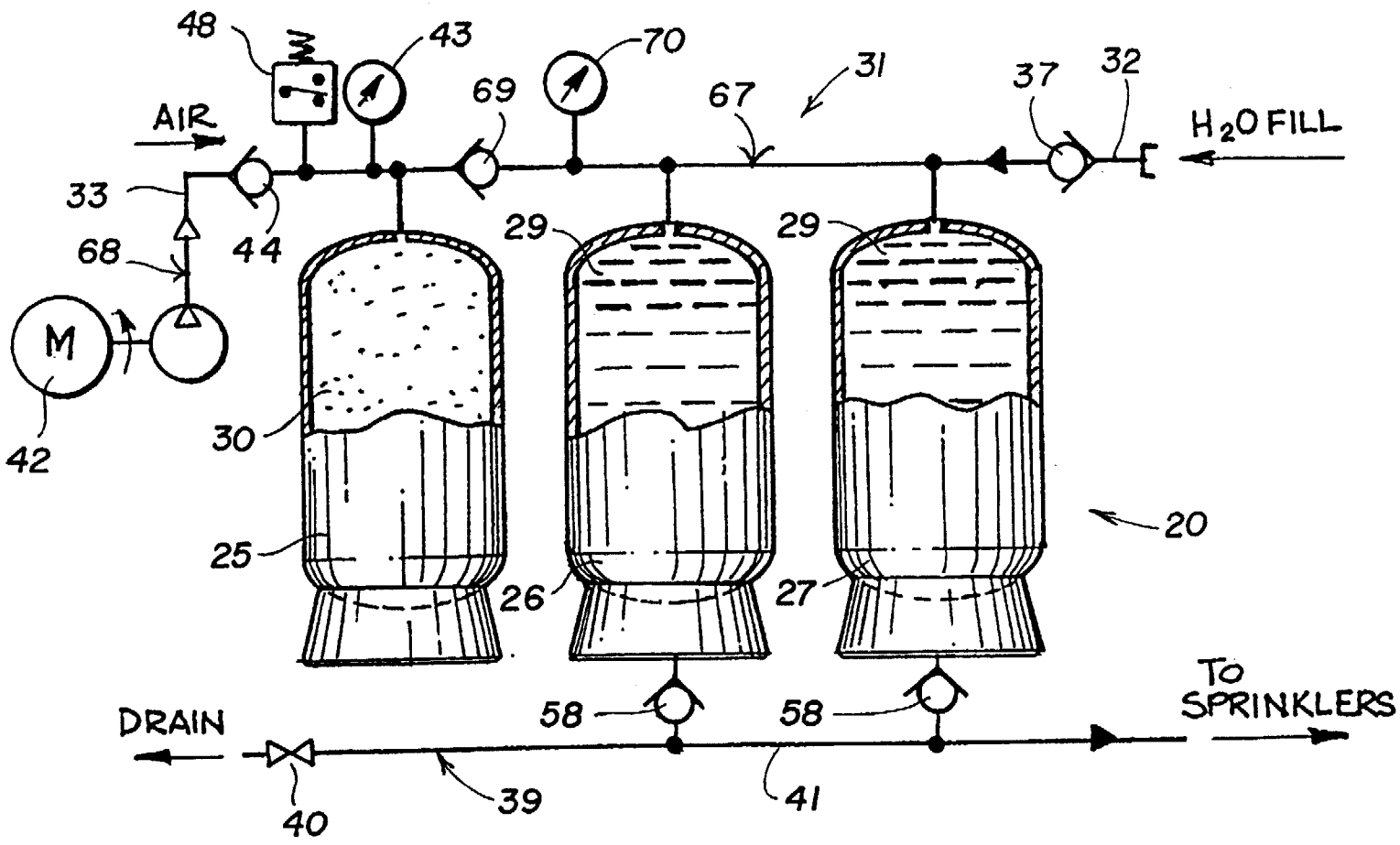
Figure 4:
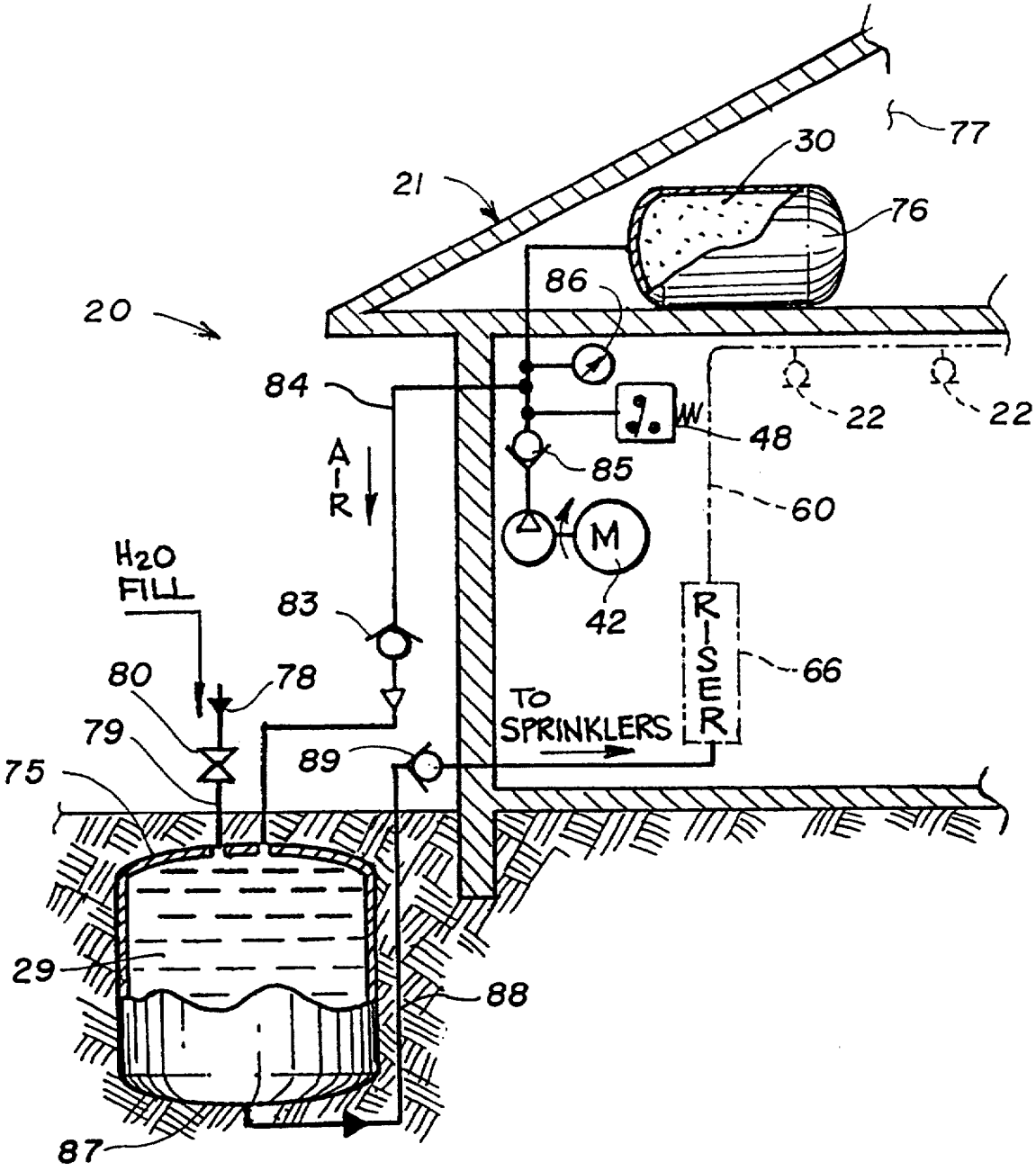

Shown in FIG. 4 is a schematic view, in elevation, of yet another preferred embodiment of the present invention. Shown is a large water tank 75 structured and arranged for preferably underground placement outside of and adjacent to home 21. The large water tank 75 is preferably made of a lightweight yet durable material such as a fiberglass reinforced polyethylene material (available from Structural North America, Chardon, Ohio). In order to supply a preferred volume of water of about 370 gallons, the large water tank has preferred dimensions of 48 inches by 72 inches. To provide the compressed air 30 required to force water 29 to the individual sprinkler heads 22, an air tank 76 is provided. Air tank 76 is preferably made of a lightweight yet durable material such as a fiberglass reinforced polyethylene material which is also available from Structural North America, Chardon, Ohio. In order to maintain a water 29 to compressed air 30 preferred ratio of 2:1 as earlier discussed, air tank 76 has preferable dimensions of 30 inches by 72 inches. The air tank 76 is preferably structured and arranged for location in a vacant area of home 21 such as, preferably, the home attic 77 as shown in FIG. 4. This embodiment allows for a home 21 with limited space, or for a variety of other reasons, to install, in a secure manner, the residential fire sprinkler water supply system 20 with little or no readily visible hardware.

Readying this embodiment of the residential fire sprinkler water supply system 20 for use is described hereinafter as follows. Preferably, a water conveyancing means such as a garden hose (not shown) is threadedly attached, in well-known ways, to the intake end 78 of intake pipe 79. An intake valve 80, preferably a ½-inch gate valve, is threadedly attached to intake pipe 79 and acts to prevent the escape of the pressurized water 29 from the large water tank 75. The large water tank 75 is then filled to capacity with water 29. Though, for illustrative purposes, only a single large water tank 75 is shown, multiple tanks may be required in order to meet the applicable NFPA water volume requirements or for cost efficiency under particular circumstances. The air tank 76 is connected to the large water tank 75 by air piping 84 which is preferably ½ inch in diameter. To prevent backflow of water 29 into air piping 84 when the system is not pressurized, an air valve 83, preferably a ½-check valve, is threadedly attached to air piping 84 between air tank 76 and large water tank 75.

To provide the compressed air 30 to air tank 76, an air compressor 42, of the kind well-known in the art of such compressors, is provided. As shown in FIG. 1, the air compressor 42 is preferably attached, in well-known piping ways, to the air pipe 79. It is to be understood that the preferred configuration of air compressor 42 is as shown, though other equivalent configurations may be used. Such other configurations may include the use of a portable air compressor in conjunction with an air hose quick-disconnect, of a well-known type, and attached in well-known ways to air piping 84. To help pneumatically seal the residential fire sprinkler water supply system 20, an air valve 85, preferably a ½-inch check valve, is threadedly attached to the air piping 84 between the air tank 76 and air compressor 42. To monitor the system pressure, an air gauge 86, of a well-known type, is threadedly attached in an appropriate place to air piping 84 and between the air tank 76 and the large water tank 75.

This preferred embodiment of the present invention is also provided with an air pressure switch 48, of a well-known type, which is threadedly attached to air piping 84 as shown in FIG. 4. The air pressure switch 48 is structured and arranged to automatically activate the air compressor 42 when the system pressure drops below pre-set levels as is fully described hereinbefore with respect to the first and second preferred embodiments.

As shown schematically in FIG. 4, in the event of a fire, one or more automatic fire sprinkler heads 22 will activate thereby causing a pressure drop in the system. This pressure drop causes water 29 to be forced from the tank bottom 87 of the large water tank 75 by the compressed air 30 in air tank 76 and into the water piping 88. A water valve 89, preferably a one-inch check valve, is threadedly attached to water piping 88 and acts to pneumatically seal the residential fire sprinkler water supply system 20 if the large water tank 75 needs to be moved of replaced. As indicated by the directional flow arrows in FIG. 4, the water 29 is then forced to the activated automatic sprinkler heads 22 by means of the transfer piping 60. As shown in FIG. 4, a fire sprinkler riser 66 may be attached, in well-known ways, to transfer piping 60. The fire sprinkler riser 66 embodies those elements required by the Local Fire Authority for testing fire sprinkler systems and is conventional and known to those skilled in the art.

As in the other preferred embodiment hereinbefore illustrated and described with respect to FIGS. 1 through 3, this preferred embodiment may also incorporate either a second air pressure switch 63 (as shown in FIG. 1), or a water flow switch 64 (as shown in FIG. 1). These switches are intended to sense a dramatic drop in air pressure or a water flow through the particular system in use. If such an air pressure drop or water flow occurs, an audible alarm (not shown) is signaled and/or an automatic dialing alarm is transmitted to the Fire Authority.

Although applicant has described applicant's preferred embodiments of this invention, it will be understood that the broadest scope of this invention includes such modifications as diverse materials, components, and configurations. Such scope is limited only by the below claims as read in connection with the above specification.

Further, many other advantages of applicant's invention will be apparent to those skilled in the art from the above descriptions and the below claims.

What is claimed is:

1. In an automatic fire sprinkler system for residences having automatic fire sprinkler heads, a limited-demand water supply system comprising:

a. vessel means for storing fluids under pressure;

b. fill means for placing water into said vessel means;

c. pressure means for applying air under pressure directly to said vessel means;

d. air pressure management means for managing application of said air under pressure to said vessel means; and e. line means for moving said water from said vessel means to a residential fire sprinkler riser system;

wherein said pressure means comprises an air compressor.

2. A water supply system according to claim 1 further comprising:

a. control means for controlling said placing water and said applying air under pressure.

3. A water supply system according to claim 2 wherein said control means comprises:

a. a set of valves structured and arranged for permitting said placing of said water into said vessel means and then permitting essentially pneumatic sealing of said vessel means to permit said applying air under pressure; and b. a set of pressure meters structured and arranged for determining fluid pressure within said control means.

4. A water supply system according to claim 2 wherein said control means is connected to said vessel means essentially above said vessel means.

5. A water supply system according to claim 2 wherein said line means is connected to said vessel means essentially below said vessel means.

6. A water supply system according to claim 1 wherein said vessel means comprises multiple vessels.

7. A water supply system according to claim 6 wherein each said vessel of said multiple vessels has a capacity of less than about 200 gallons.

8. A water supply system according to claim 6 wherein each said vessel of said multiple vessels is partially filled with water.

9. A water supply system according to claim 8 wherein about two-thirds of each said vessel of said multiple vessels is filled with water.

10. A water supply system according to claim 6 wherein at least one vessel of said multiple vessels is essentially completely filled with air under pressure.

11. A water supply system according to claim 10 wherein at least one vessel of said multiple vessels is essentially filled with water.

12. A water supply system according to claim 11 wherein said at least one vessel essentially filled with water is situated beneath ground level.

13. A water supply system according to claim 12 wherein said at least one vessel essentially filled with air under pressure is situated in a residential attic.

14. A water supply system according to claim 1 wherein said vessel means contains, by volume, about two-thirds water and about one-third air under pressure.

15. A water supply system according to claim 14 wherein said air under pressure is under a pressure of about 150 psi.

16. A water supply system according to claim 1 wherein said vessel means is made of fiberglass-reinforced polymeric material.

17. A limited-demand water supply system comprising:

a. residential housing structure;

b. a plurality of automatic fire sprinkler heads placed within said residential fire structure;

c. a riser pipe system connecting said fire sprinkler heads with a supply of on-site stored water pressurized under sufficient air pressure to empty said stored water through said fire sprinklers, when open;

d. said supply of on-site stored water being contained in a plurality of connected vessels.

18. A water supply system according to claim 17 wherein each of said plurality of connected vessels has a capacity of less than about 200 gallons.

19. A water supply system according to claim 17 wherein said vessels are made of fiberglass-reinforced polymeric material.

20. A water supply system according to claim 17 wherein said on-site stored water is pressurized by a gas contained in an additional vessel fluidly coupled to said plurality of connected vessels.

* * * * *

UNITED STATES PATENT AND TRADEMARK OFFICE

CERTIFICATE OF CORRECTION

PATENT NO. : 6,009,954
DATED : January 4, 2000
INVENTOR(S) : Mark A. Phillips

It is certified that error appears in the above-identified patent and that said Letters Patent is hereby corrected as shown below:

Title page,
Showing the illustrative figure should be deleted, and substitute therefor the attached title page.
Replace the drawings containing Figures 1 through 4 with the attached four sheets of drawings containing Figures 1 through 4.

Signed and Sealed this

Fourth Day of December, 2001

*Attest:*

Nicholas P. Godici

NICHOLAS P. GODICI
*Acting Director of the United States Patent and Trademark Office*

*Attesting Officer*

United States Patent [19]

Phillips

[11] Patent Number: 6,009,954

[45] Date of Patent: Jan. 4, 2000

[54] RESIDENTIAL FIRE SPRINKLER WATER SUPPLY SYSTEM

[76] Inventor: Mark A. Phillips, 2725 N. 21st St., Phoenix, Ariz. 85006

[21] Appl. No.: 09/026,997

[22] Filed: Feb. 23, 1998

[51] Int. Cl.[7] ..... A62C 35/00

[52] U.S. Cl. ..... 169/16; 169/9

[58] Field of Search ..... 169/9, 14, 16

[56] References Cited

U.S. PATENT DOCUMENTS

| | | | |
|---|---|---|---|
| 786,742 | 4/1905 | Evans | 169/9 |
| 2,353,116 | 7/1944 | Rider | 169/9 |

*Primary Examiner*—Kevin P. Shaver
*Assistant Examiner*—David Deal

[57] ABSTRACT

Described is a limited-demand water supply system for use in residential homes wherein a supply of water is automatically provided to fire sprinklers by means of air pressure. Multiple tanks or vessels in a connected fluid system are partially filled with water and then pressurized with air pressure provided by an air compressor. There is maintained sufficient air pressure to empty the water in the vessel system through the fire sprinkler heads, when open. Preferably, to efficiently comply with most current fire system regulations, a set of vessels of less than about 200 gallons capacity each is filled about two-thirds with water and then air-pressurized to about 150 pounds per square inch.

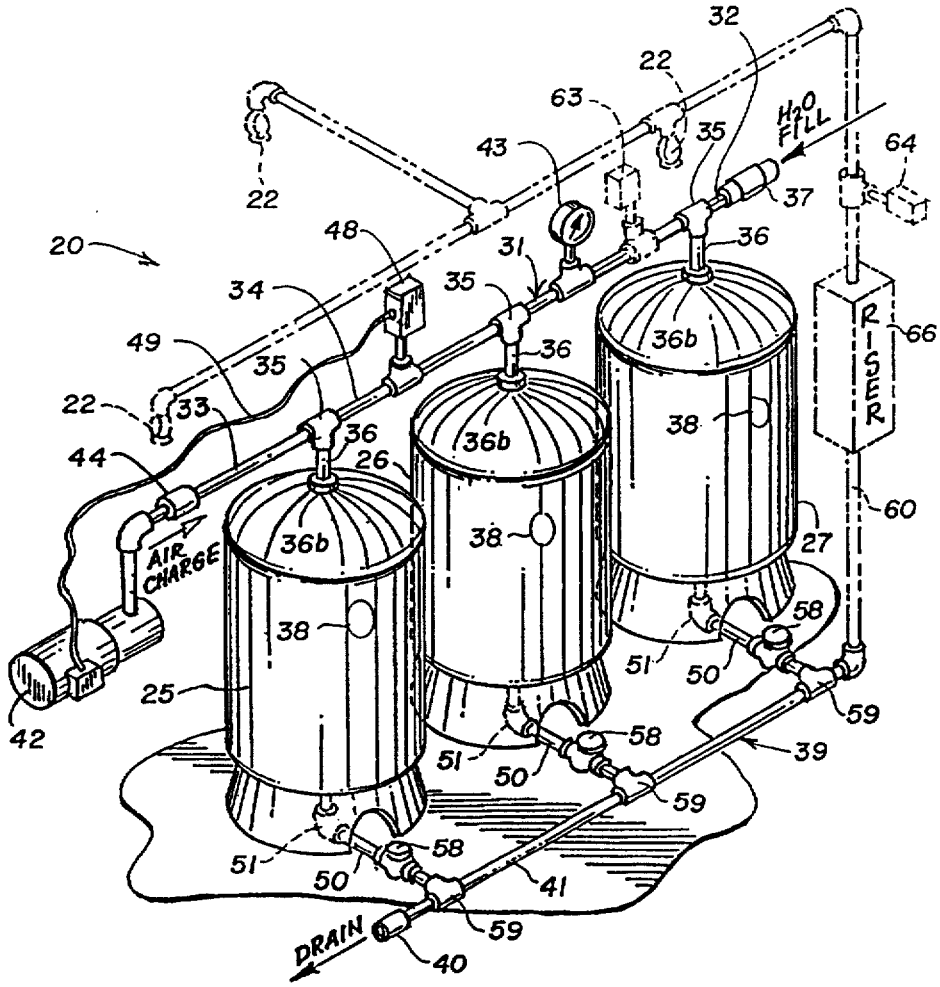

20 Claims, 4 Drawing Sheets